US006082029A

United States Patent [19]

Hoffman

[11] Patent Number: 6,082,029

[45] Date of Patent: Jul. 4, 2000

[54] CONTAINER FOR PACKAGING AND DISPLAYING A PLAQUE

[76] Inventor: Abraham Hoffman, 9 Mordeche Scher Blvd., Monroe, N.Y. 10950

[21] Appl. No.: 09/187,212

[22] Filed: Nov. 6, 1998

[51] Int. Cl.[7] ..... G09F 1/00

[52] U.S. Cl. ..... 40/124.06; 40/723

[58] Field of Search ..... 40/124.06, 723, 40/765, 766, 775, 776, 779, 762, 777

[56] References Cited

U.S. PATENT DOCUMENTS

| | | | |
|---|---|---|---|
| 1,143,729 | 6/1915 | Schmidt . | |
| 2,314,721 | 3/1943 | Lowenstein . | |
| 2,672,274 | 3/1954 | Crane . | |
| 3,292,290 | 12/1966 | Potter . | |
| 3,739,511 | 6/1973 | Freedman | 40/124.06 X |
| 4,001,958 | 1/1977 | Fecko | 40/124.06 |
| 4,440,298 | 4/1984 | Knight | 40/776 X |
| 4,934,078 | 6/1990 | Sloot | 40/765 X |
| 5,096,058 | 3/1992 | Juravin et al. | 40/124.06 X |
| 5,232,087 | 8/1993 | Schluger | 40/124.06 X |
| 5,458,235 | 10/1995 | Stone | 40/124.06 X |
| 5,845,425 | 12/1998 | Leake et al. | 40/124.06 X |

*Primary Examiner*—Terry Lee Melius
*Assistant Examiner*—William L. Miller
*Attorney, Agent, or Firm*—Robert L. Epstein; Harold James; James & Franklin, LLP

[57] ABSTRACT

The plaque has an indicia carrying surface. The container includes a box-like enclosure with an openable end and front surface having an opening. The plaque is received through the end of the enclosure such that the indicia carrying surface of the plaque aligns with the opening. A cover is hingeably mounted on the surface of the enclosure. The cover has window. A card, with indicia corresponding to the indicia on the plaque surface, is removeably mounted on the interior surface of the cover so as to be visible through the window. The rear surface of the plaque has a pocket to retain the card after the plaque and card are removed from the enclosure. A stand is provided to maintain the plaque in an upright position.

11 Claims, 2 Drawing Sheets

FIG. 2
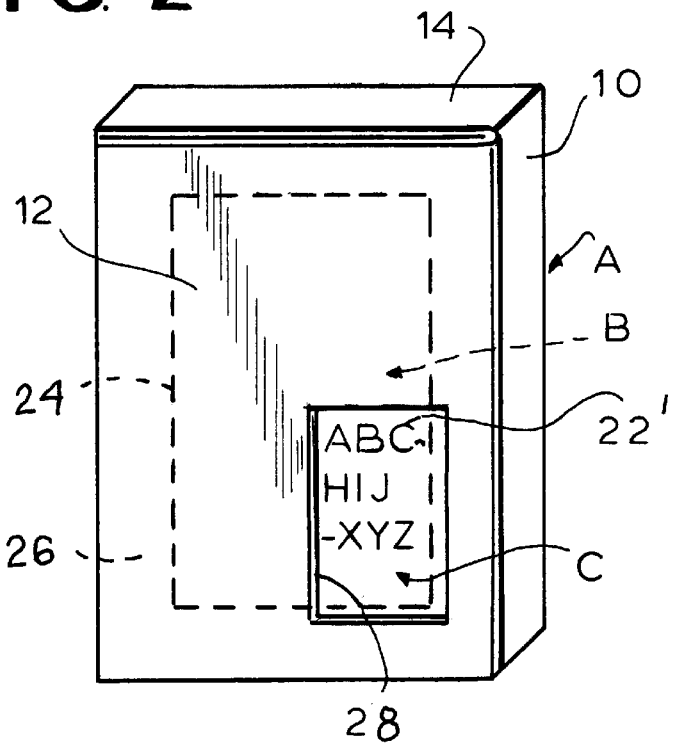
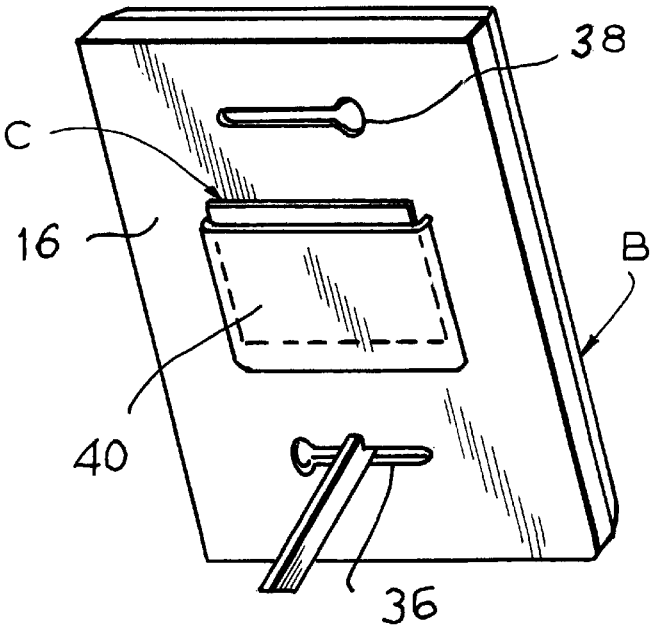
FIG. 3

CONTAINER FOR PACKAGING AND DISPLAYING A PLAQUE

The present invention relates to a decorative plaque and more particularly to a container for packaging and displaying a decorative plaque.

Decorative plaques made of wood, metal or plastic having a surface carrying various indicia such as poems, holiday or birthday greetings, or graphics such as an athletic team logo, are commonly sold in greeting card stores and novelty shops. The plaques are sometimes enclosed in transparent shrink wrap plastic which allows the indicia carrying surface of the plaques to be visible to the purchaser. Other times the plaques are sold in cardboard boxes which protect the plaque but obscure the indicia carrying surface.

The plaques are often purchased as a gift, along with a separate greeting card with a suitable message. Since there is no facility for affixing the card to the plaque, it must be given separately or taped to the plaque package. Once the package is removed, there is no convenient way keeping the card together with the plaque.

I have therefore invented a simple, inexpensive and asthetically pleasing container for packaging and displaying a plaque which is designed to be used in conjunction with a greeting card. My invention includes an enclosure which protects the plaque from being scratched or dented during shipping and handling. The enclosure has a cover which carries a greeting card. The card is visible through a window in the cover. One side of the greeting card has the same indicia as the plaque (usually reduced in size) so that the purchaser can see what is imprinted on the plaque without having to open the cover. The other side of the greeting card is blank so that the purchaser can write a personal message on it. A pocket is provided on the rear surface of the plaque. The pocket can retain the card, after the container is discarded, if the card is to be preserved.

The enclosure itself is made of a paper product, such as light weight cardboard. When the cover is opened in book-like fashion, the indicia carrying surface of the plaque is visible through an opening in the front surface of the enclosure. With the cover partially open, the enclosure can stand upright with the indicia carrying surface of the plaque visible. The plaque can be removed from the enclosure and mounted on a wall. A stand is provided for maintaining the plaque in an upright position on a horizontal surface as well.

It is, therefore, a prime object of the present invention to provide a container for packaging and displaying an indicia carrying plaque.

It is another object of the present invention to provide a container for a plaque which carries a greeting card visible from the exterior of the container, where the greeting card carries indicia corresponding to the indicia on the plaque.

It is another object of the present invention to provide a container for packaging and displaying a plaque which has simple, inexpensive construction which functions reliably.

In accordance with the present invention, a plaque and a container for packaging and displaying the plaque are provided. The plaque includes an indicia carrying surface. The container is a generally box-like enclosure with an openable end and a front surface with an opening. The enclosure is adapted to receive the plaque through the end, such that the indicia carrying surface is aligned with the opening in the front surface of the enclosure. The container also has cover means hingeably connected along one side of the front surface of the plaque. The cover means is moveable relative to the surface between a position wherein the front surface opening is exposed and a position wherein the front surface opening is covered.

A card is provided. The card may have indicia corresponding to the indicia on the plaque surface. Means for affixing the card on the cover means are also provided.

A window is situated in the cover means. The card is aligned with and is visible through the window. Means are provided for removeably affixing the card to the cover means. The cover means includes an interior surface. Card affixing means is situated on the interior surface of the cover means.

Means affixed to the body of the plaque is provided for retaining the card. The card retaining means preferrably comprises a pocket. The body has a surface opposite to the indicia carrying surface. The card retaining pocket is affixed to the opposite body surface.

Stand means are provided. The stand means is adapted to cooperate with the plaque to maintain the plaque in an upright position.

To these and such other objects which may hereinafter appear, the present invention relates to a container for packaging and displaying a plaque, as described in detail in the following specification and recited in the annexed claims, taken together with the accompanying drawings, wherein like numerals refer to like parts and in which:

FIG. 2 is a front perspective view of the present invention with the cover closed; and FIG. 3 is a rear perspective view of the plaque, pocket and stand.

Figure 1:
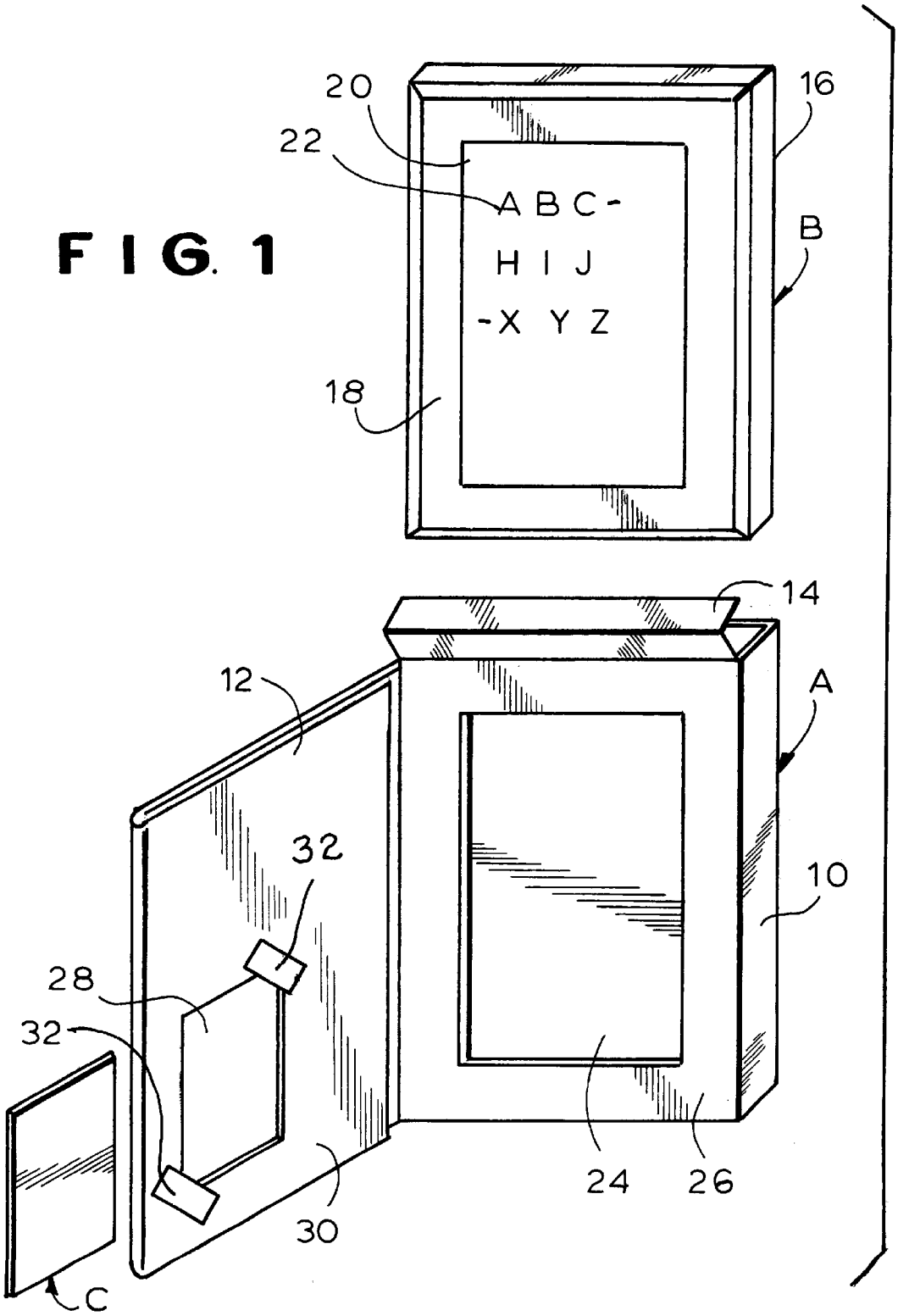
FIG. 1 is an exploded perspective view of the container, plaque and card of the present invention.

As seen in FIG. 1, the present invention consists of a book-like container, generally designated A, including a box-like enclosure 10 with a hingeably mounted cover 12. Enclosure A is preferrably made of a heavy paper or light cardboard sheet cut and folded in an appropriate manner. A plaque, generally designated B, is adapted to be received within enclosure 10 through a flap 14 which forms the top of enclosure 10.

Plaque B includes a generally rectangular body 16 made of wood, metal or plastic. The front surface 18 of plaque body 16 has affixed thereto, by adhesive or other conventional means, a sheet 20 of metal, plastic or paper with indicia 22 imprinted thereon.

Enclosure 10 has a opening 24 in its front surface 26. Opening 24 is preferrably approximately the same size and shape as sheet 22 on plaque B. Thus, when plaque B is received within enclosure 10, sheet 22 is visible through opneing 24, if cover 12 is open.

Cover 12 has a generally rectangular window 28. A greeting card, generally designated C, is preferrably removeably attached to the interior surface 30 of cover 12 by a pair of paper or plastic strips 32, strips 32 are located at opposite corners of window 28 and are glued to surface 30 on three sides such that the corners of card C can lodge underneath when the card is flexed.

Card C is imprinted with indicia 22' on its front surface. In indicia 22' preferrably correspond to (but may be smaller than) indicia 22 on sheet 20. Thus, when the card C is received behind window 28 of cover 12 and the cover is closed, as seen in FIG. 2, a prospective purchaser can observe what is written on the plaque by looking at indicia 22' on card C. This is important because the container is designed to be displayed for sale with the cover closed and the container encased in transparent shrink wrap plastic.

After purchase, the shrink wrap is removed and the cover opened to display indicia 22 on the plaque through opening 24. The rear surface of card C is purposely left blank so that the purchaser may inscribe a personal note to the recipient. That note will be visible when the cover is open.

Plaque B may be removed from container A by opening flap 14. A stand 34, which is an elongated piece of rigid material, such as plactic or metal, is provided to maintain plaque B in an upright position on a horizontal surface, such as a table top. One end of stand 34 includes a protrusion or key (not shown) which is adapted to be removeably received in a lower keyway or slot 36 on the rear surface of the plaque body. An upper keyway or slot 38 is also provided on the rear surface of the plaque to permit the plaque to hang from a nail or hook on a wall.

A vinyl or paper sheet 40 is glued or otherwise affixed to the rear surface of plaque B along its side and bottom edges so as to form a pocket to retain card C after the card is removed from the cover. Thus, the recipient may conveniently retain the card, with its personal note, with the plaque.

As will now be appreciated, the present invention is a container for packaging and displaying a plaque. The container has a book-like configuration and includes an enclosure which receives the plaque and a cover which holds a greeting card. The greeting card carries indicia corresponding to the indicia on the plaque. The indicia on the front surface plaque are visible through an opening in the enclosure, when cover is open. The indicia on the card can be viewed through a window in the cover, when the cover is closed, by observing the greeting card. A pocket is provided on the back of the plaque to retain the card, after the plaque is removed from the cover.

While only a single preferred embodiment of the present invention has been disclosed herein for purposes of illustration, it is obvious that many variations and modifications could be made thereto. It is intended to cover all of these variations and modifications which fall within the scope of the present invention, as defined by the following claims:

I claim:

1. In combination, a plaque and a container for packaging and displaying said plaque, said plaque comprising a body, a sheet affixed to said body and having an indicia carrying surface, said container comprising a generally box-like enclosure with an openable end and a surface with an opening, said enclosure being adapted to receive said plaque through said end such that said indicia carrying surface is aligned with said opening, cover means hingeably connected along said enclosure surface, said cover means being moveable relative to said enclosure surface between a position wherein said enclosure surface opening is exposed and a position wherein said enclosure surface opening is covered.

2. The combination of claim 1, further comprising a card.

3. The combination of claim 2, further comprising means for removeably affixing said card to said cover means.

4. The combination of claim 1, wherein said card comprises indicia corresponding to the indicia carried on said plaque body surface.

5. The combination of claim 1, further comprising stand means adapted to cooperate with said plaque to maintain said plaque in an upright position.

6. The combination of claim 1 wherein said body of said plaque is rectangular.

7. The combination of claim 1 wherein said body is substantially the same size and shape as said enclosure.

8. In combination, a plaque and a container for packaging and displaying said plaque, said plaque comprising an indicia carrying surface, said container comprising a generally box-like enclosure with an openable end and a surface with an opening, said enclosure being adapted to receive said plaque through said end such that said indicia carrying surface is aligned with said opening, cover means hingeably connected along said enclosure surface, said cover means being moveable relative to said enclosure surface between a position wherein said enclosure surface opening is exposed and a position wherein said enclosure surface opening is covered, a card and a window in said cover means through which said card is visible.

9. In combination, a plaque and a container for packaging and displaying said plaque, said plaque comprising an indicia carrying surface, said container comprising a generally box-like enclosure with an openable end and a surface with an opening, said enclosure being adapted to receive said plaque through said end such that said indicia carrying surface is aligned with said opening, cover means hingeably connected along said enclosure surface, said cover means being moveable relative to said enclosure surface between a position wherein said enclosure surface opening is exposed and a position wherein said enclosure surface opening is covered, a card and means affixed to said plaque for retaining said card.

10. The combination of claim 9, wherein said card retaining means comprises a pocket.

11. The combination of claim 9, wherein said plaque has a surface opposite to said indicia carrying surface and wherein said card retaining means is affixed to said opposite surface.

* * * * *